US006854248B2

(12) United States Patent
Kaesgen et al.

(10) Patent No.: US 6,854,248 B2
(45) Date of Patent: Feb. 15, 2005

(54) REARWARDLY AND DOWNWARDLY-FACING FILTER ENTRANCE FOR STRING TRIMMER

(75) Inventors: Hartmut Kaesgen, Berea, OH (US); Dennis Fowler, Brunswick, OH (US)

(73) Assignee: MTD Products Inc, Valley City, OH (US)

( * ) Notice: Subject to any disclaimer, the term of this patent is extended or adjusted under 35 U.S.C. 154(b) by 578 days.

(21) Appl. No.: 09/737,781

(22) Filed: Dec. 15, 2000

(65) Prior Publication Data

US 2001/0023574 A1 Sep. 27, 2001

Related U.S. Application Data

(60) Provisional application No. 60/172,130, filed on Dec. 17, 1999.

(51) Int. Cl.[7] ..... A01D 34/00
(52) U.S. Cl. ..... 56/12.7; 56/14.7
(58) Field of Search ..... 56/12.7, 14.7, 56/16.7; 30/276

(56) References Cited

U.S. PATENT DOCUMENTS

| | | | | | |
|---|---|---|---|---|---|
| 4,205,439 | A | * | 6/1980 | Sweet | 30/276 |
| 4,245,455 | A | * | 1/1981 | Martin | 56/12.8 |
| 4,261,302 | A | | 4/1981 | Sheldon | 123/41.7 |
| 4,286,675 | A | * | 9/1981 | Tuggle | 30/276 |
| 4,403,971 | A | * | 9/1983 | Kobayashi et al. | 440/88 |
| 4,619,674 | A | * | 10/1986 | Erdmannsdorfer | 55/486 |
| 4,826,512 | A | | 5/1989 | Fuller | 55/283 |
| 4,838,908 | A | | 6/1989 | Bader et al. | 55/385.1 |
| 4,878,339 | A | * | 11/1989 | Marier et al. | 180/19.1 |
| 4,936,886 | A | * | 6/1990 | Quillen | 56/12.7 |
| 4,953,449 | A | * | 9/1990 | Jackson | 454/138 |
| 5,046,976 | A | * | 9/1991 | Kobayashi et al. | 123/195 P |
| 5,174,255 | A | * | 12/1992 | Collins et al. | 123/179.1 |
| 5,322,534 | A | | 6/1994 | Kaiser | 55/283 |
| 5,345,684 | A | * | 9/1994 | Shoup et al. | 30/276 |
| 5,367,988 | A | | 11/1994 | Collins | 123/41.65 |
| 5,522,355 | A | * | 6/1996 | Uhl | 123/195 C |
| 5,526,777 | A | | 6/1996 | Taomo et al. | 123/41.65 |
| 5,570,751 | A | * | 11/1996 | Courtwright et al. | 123/198 E |
| 5,632,243 | A | | 5/1997 | Buchholz | 123/198 |
| 5,819,696 | A | | 10/1998 | Wada | 123/198 |
| 5,826,414 | A | * | 10/1998 | Lenczuk | 56/14.7 |
| 5,862,655 | A | * | 1/1999 | Altamirano et al. | 56/12.7 |
| 5,947,219 | A | * | 9/1999 | Peter et al. | 180/68.1 |
| 6,085,503 | A | * | 7/2000 | Hutchinson | 56/12.7 |
| 6,105,349 | A | * | 8/2000 | Busboom et al. | 56/14.7 |
| 6,227,162 | B1 | * | 5/2001 | Dahlberg et al. | 123/198 E |

* cited by examiner

*Primary Examiner*—Thomas B. Will
*Assistant Examiner*—Nathan Mammen
(74) *Attorney, Agent, or Firm*—Wegman, Hessler & Vanderburg

(57) ABSTRACT

A string trimmer having the entrance to the air filter generally facing away from the forward direction of travel. Further, the filter intake is generally planar and is angled downwardly away from the plane normal to the direction of travel. The cross-sectional area of the filter intake is sized so as to reduce the velocity of air flowing through the filter intake.

12 Claims, 5 Drawing Sheets

REARWARDLY AND DOWNWARDLY-FACING FILTER ENTRANCE FOR STRING TRIMMER

This application claims the benefit of Provisional Application No. 60/172,130, filed Dec. 17, 1999.

BACKGROUND OF THE INVENTION

1. Field of the Invention

This invention pertains to the art of filter assemblies, and more specifically to air filter assemblies for use with internal combustion engines, such as would be used in apparatuses in the lawn care industry.

2. Description of the Related Art

Internal combustion engines ignite combined air and fuel for the combustion process. It is important that the mixture remains free from particulate contamination so as not to damage the engine components and provide for extended operation of the engine. It is known in the art to provide such engines on vegetation mowing devices, such as string trimmers and lawn mowers, it is also known to provide engines with an air filtration system for filtering debris from the flow of air entering the engine. A detailed explanation of the necessity of keeping the air-fuel mixture clean will not be given here, as it is well known in the art.

Filters are prone to clogging by debris, including the severed vegetation generated by the mower cutting action as well as additional particulate contamination such as dust, dirt and the like. As filters become saturated with the debris, it reduces the flow of air into the engine necessary for continued operation. In applications where a mowing device is used, typical amounts of debris can require frequent maintenance of the filter in order to provide the engine with a constant source of clean air. This can be cumbersome, time consuming and costly.

One common apparatus used in the lawn care industry is a string trimmer. A string trimmer is often utilized to complement other lawn care devices such as lawn mowers. String trimmers have the advantage of being able to get into small areas, where lawn mowers often cannot reach. String trimmers utilize a rotating shaft having strings positioned at a lower end thereof. When rotating, the strings have sufficient rigidity and inertia to cut vegetation such as grass, weeds, and the like. String trimmers are able to cut the vegetation growing close to rigid objects such as mailboxes and the edges of buildings because the rotating strings do not damage or cut these obstacles.

One of the problems faced by string trimmers is the generation of dust and debris by rotation of the strings. The dust and debris, as well as the cut vegetation, become airborne. In string trimmers known from the prior art, these airborne particles are often found in the vicinity of the air intake opening which supplies the necessary air to the internal combustion engine.

Even with the presence of a filter, an unacceptable amount of debris can enter the engine. Also, even if the filter is effective in preventing the passage of the material to the engine, the presence of debris against the filter can starve the engine for air and thereby limit engine performance.

One attempt to obviate the problems associated with the entry of debris is described in U.S. Pat. No. 4,838,908. The patent discloses an invention that diverts the flow of debris-filled air through a series of abrupt directional changes. In theory, the contour of the pathway and gravity work together to trap the particles prior to entry into the air intake of the internal combustion engine. However, particles are still received into to the housing.

Another invention as described in U.S. Pat. No. 4,261,302, discloses an inclined lip that upwardly deflects solid particles in the air away from the opening where the air enters for the fuel-air mixture.

U.S. Pat. No. 5,322,534 discloses a self-cleaning filter. This patent discloses a flexible filter bag in an upside-down position with its open end firmly supported. Air to be cleaned is pulled upwardly through the bag. When the air stream is shut off, the bag collapses, discharging accumulated particulate material into the space beneath it.

Still another invention as described by U.S. Pat. No. 5,947,219 discloses a vehicle having an engine and an air grill. The air grill is disclosed to be positioned away from the engine exhaust and to include air inlets that receive air to cool the engine. The patent discloses a separate air cleaner for use in combustion.

The lawn apparatuses, especially string trimmers, known in the art generally locate the air intake and filtering assembly toward the upper end of a housing so as to be away from the production of the debris. However, because the debris becomes airborne, even filtering assemblies located at the top of a lawn apparatus is subject to clogging. The present invention is directed to a lawn apparatus having a filtering assembly positioned so as to minimize clogging of the filter and to discourage debris from entering the motor housing.

SUMMARY OF THE INVENTION

In accordance with the present invention, an apparatus is provided including a frame mounted on a pair of wheels and having a front end with respect to a forward direction of travel, cutting means adapted for cutting vegetation, an engine carried on the frame for providing power to drive the cutting means, and means for supplying air to the engine, wherein the engine has an associated engine air intake having a first cross-sectional area $A_1$, and the air is supplied at a predetermined air volumetric flow rate, F, to define a constant first velocity $V_1$, wherein $V_1=F/A_1$. The apparatus comprises filtering means for filtering the air supplied to the engine, the filtering means including a generally planar filter air intake having an associated second cross-sectional area $A_2$, wherein at the predetermined air volumetric flow rate F, $A_2$ has a predetermined value provides a decreased velocity of air $V_2$ wherein $V_1-V_2$ is a predetermined amount.

According to one aspect of the invention, the filtering means is positioned relative to the frame so that the filter air intake generally faces away from the front end.

According to another aspect of the invention, the filter air intake lies generally in a plane which is angled away from the front end of the frame by an angle between 5° and 85° with respect to a plane normal to the forward direction of travel.

According to another aspect of the invention, the apparatus is a string trimmer and the cutting means comprises a plurality of cords; and, rotating means for rotating the cords, the rotating means being powered by the engine.

According to another aspect of the invention, an apparatus is provided which includes a frame mounted on a pair of wheels, the frame having a front end with respect to a forward direction of travel, cutting means adapted for cutting vegetation, an engine carried on the frame for providing power to drive the cutting means, and means for supplying air to the engine. The apparatus comprises filtering means for filtering the air supplied to the engine, the filtering means including a generally planar filter air intake having at least a minimal cross-sectional area effective to maintain a minimal volumetric air flow to the engine, wherein the filtering means is positioned relative to the frame so that the filter air intake generally faces away from the front end.

According to another aspect of the invention the cross-sectional area of the filter air intake is greater than the minimal cross-sectional area to reduce the velocity of air passing through the filter intake.

According to another aspect of the invention, a method for reducing engine failure due to overheating because of a clogged air filter is provided. The method comprises the steps of providing filtering means for filtering the air supplied to the engine, the filtering means including a generally planar filter air intake; and, positioning the filtering means relative to the frame so that the filter air intake generally faces away from the front end.

According to yet another aspect of the invention, the method includes the step of positioning the filtering means so that the filter air intake lies generally in a plane which is angled away from the front end of the frame by an angle between 5° and 85° with respect to a plane normal to the direction of travel.

One advantage of the present invention is that the reduced velocity of air flowing through the filter air intake will pull airborne debris with lesser force and therefor will keep the filter cleaner than other prior art filters.

Another advantage of the present invention is that positioning the filter air intake away from the forward direction of travel will means that air is pulled into the engine from an area less contaminated with airborne debris.

Another advantage of the present invention is that angling the face of the filter air intake away from the normal plane will allow gravity to pull debris away from the filter, especially when the apparatus travels over rough or uneven ground and when the engine is turned off.

Still other advantages of the present invention will be apparent to those skilled in the art upon a reading and understanding of the following description of the invention.

DESCRIPTION OF THE PREFERRED EMBODIMENT

Figure 1:
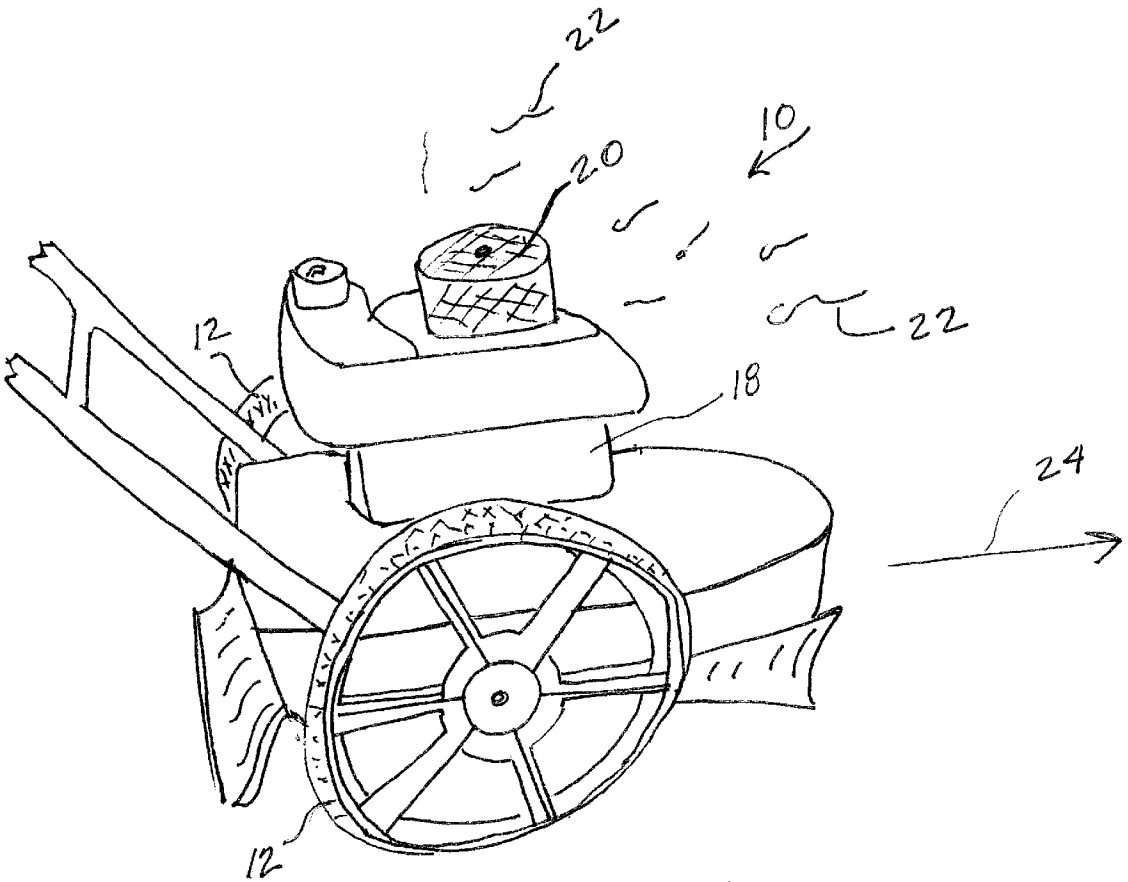
FIG. 1 PRIOR ART
FIG. 1 is a prior art string trimmer having the air filter assembly mounted above the engine and the frame.

FIG. 1 shows a prior art string trimmer 10 showing the usual elements of wheels 12, frame 16, an engine (not shown) enclosed in engine housing 18. The engine drives the cutting means (not shown in this view) which may include rotatable strings. Air supplied to the engine is pulled through a filter assembly 20. In FIG. 1, and in other models known in the art, it is common to carry the filter assembly 20 above the engine housing 18 near the centerline of the trimmer 10.

The positioning of the filter assembly 20 as described above causes many problems in the art. Airborne debris 22 is pulled toward the filter assembly 20 because the direction of forward travel, shown by arrow 24, puts the filter assembly 20 directly in the path of the airborne debris 22. Further, any debris 22 that flies higher than the filter assembly 20 is pulled downward by gravity, where it may come to rest against the filter assembly 20. The action of pulling fine debris into the filter itself can cause frequent maintenance and/or engine malfunction. Additionally, debris 22 held by the air flow against the filter assembly 20 can significantly reduce the flow of air to the engine and cause overheating and malfunction. Because of the positioning of the filter assembly 20, even when the engine is turned off, the debris 22 remains against the filter assembly 20. Both of these adverse conditions are addressed by the present invention.

Figure 2:
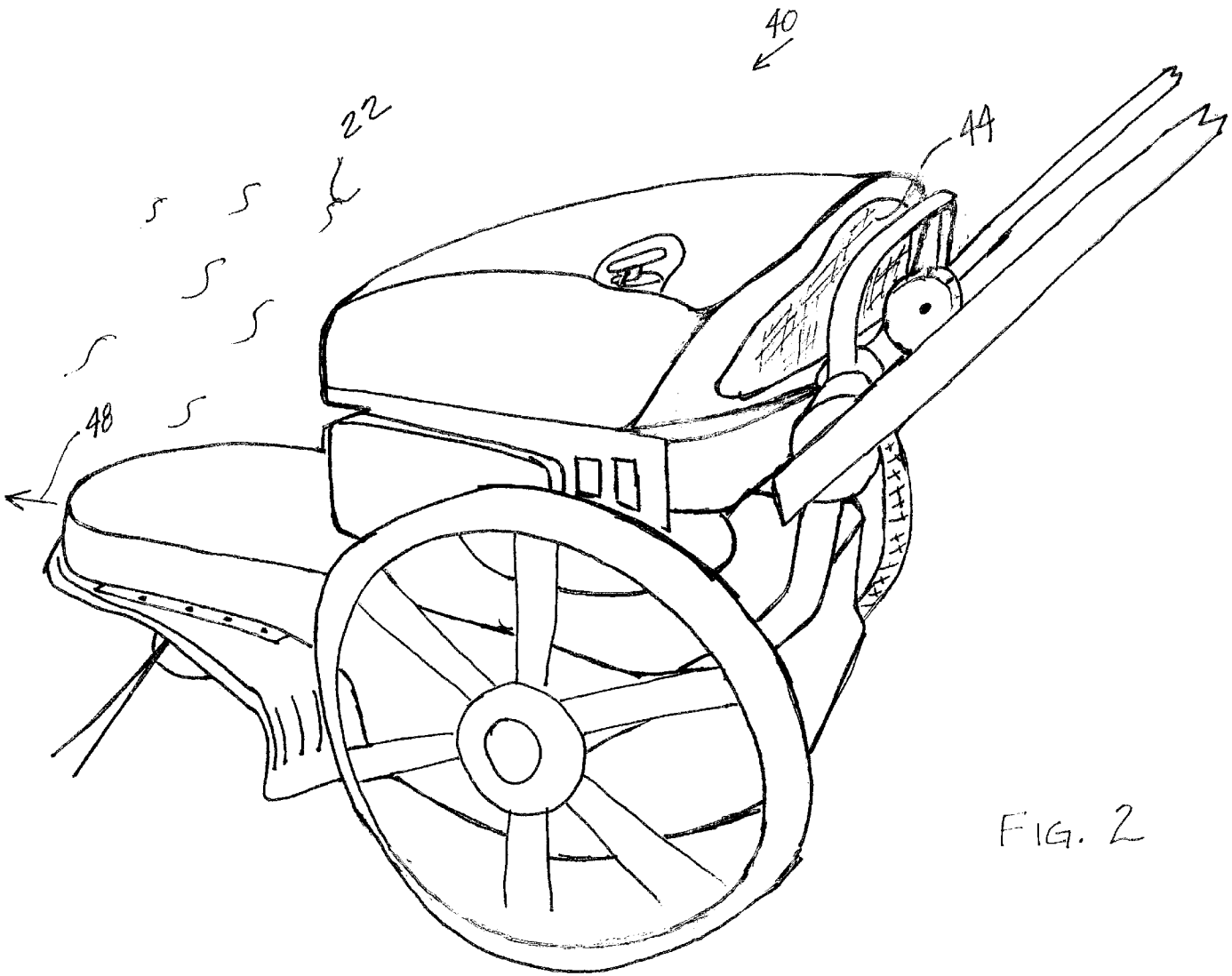
FIG. 2 shows one embodiment of a string trimmer wherein the filter air intake is positioned to the rear of the string trimmer.

It has been discovered that the filter location and orientation of the air intake can be modified to improve performance. Specifically, with reference now to FIG. 2, an improved string trimmer 40 is shown. In this preferred embodiment, the filter air intake 44 is essentially planar. The filter air intake 44 is positioned to generally face away from the forward direction of travel as indicated by arrow 48. The filter air intake 44 faces in a generally downwardly direction. Locating the filter air intake 44 away from the forward direction of travel means that air is pulled toward the filter air intake 44 from an environment having significantly less airborne debris 22.

Figure 3:
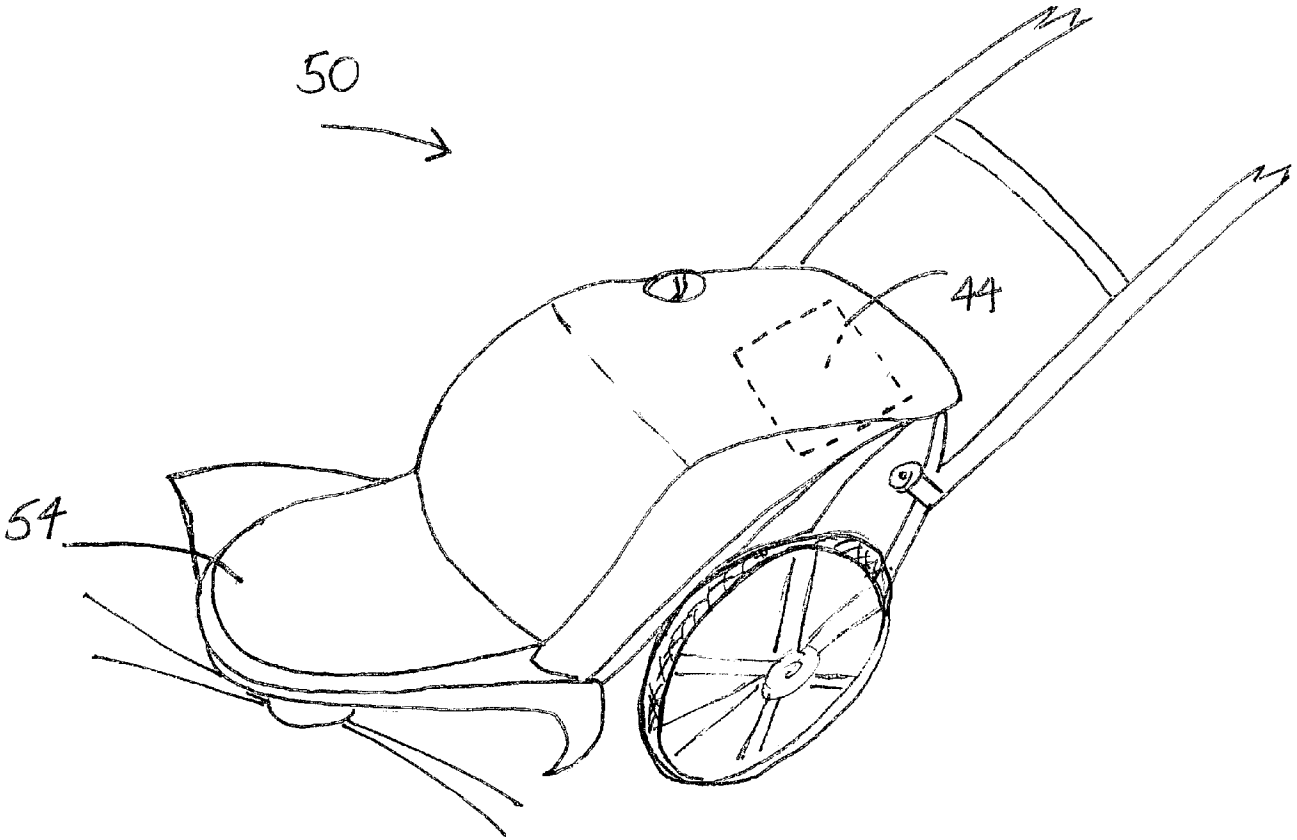
FIG. 3 shows a second embodiment of a string trimmer wherein the filter air intake is positioned to the rear of the string trimmer.

FIG. 3 shows yet another embodiment of a string trimmer 50. The location of the filter air intake 44 is shown in dotted lines. Again, this embodiment locates the filter air intake 44 in a downwardly direction and away from the front end 54 of the trimmer 50.

Figure 4:
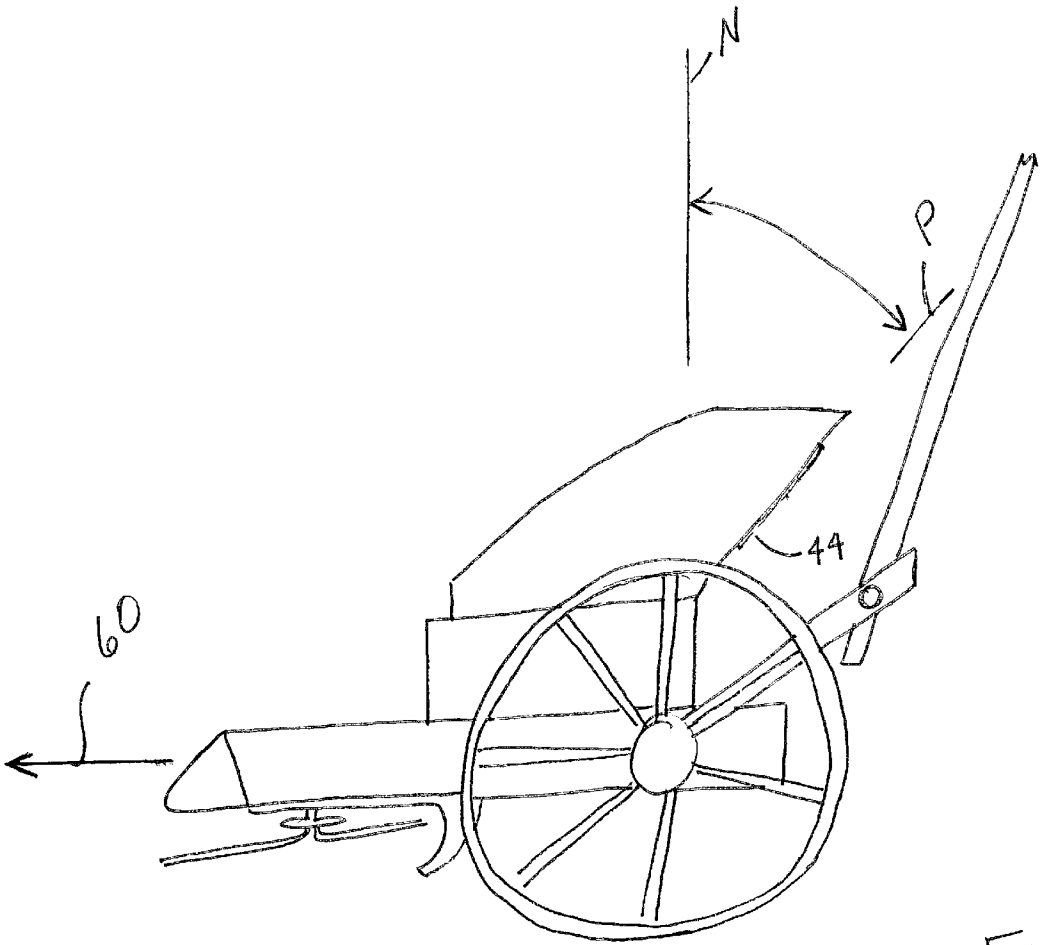
FIG. 4 is a representation of side view of a string trimmer.

Another aspect of the present invention is illustrated in FIG. 4. In this drawing, the direction of forward travel is indicated by arrow 60. The filter air intake 44 generally lies in plane P. In the preferred embodiment, plane P is not coincident with a plane N, normal to the forward direction of travel, but is angled away from N by 5° to 85°. As shown, the filter air intake is positioned in a generally downwardly direction. It is believed that angling the filter air intake 44 provide two important advantages of the present invention. Firstly, it requires that the air pass upwardly through the filter air intake 44 before traveling downwardly into the engine. It is believed that requiring the air to pass upwardly will enable gravity to drop some of the suspended particulate debris out of the air stream before it passes through the filter air intake 44. Additionally, debris which is pulled against the filter air intake 44 may dislodge due to the effects of gravity.

Figure 5:
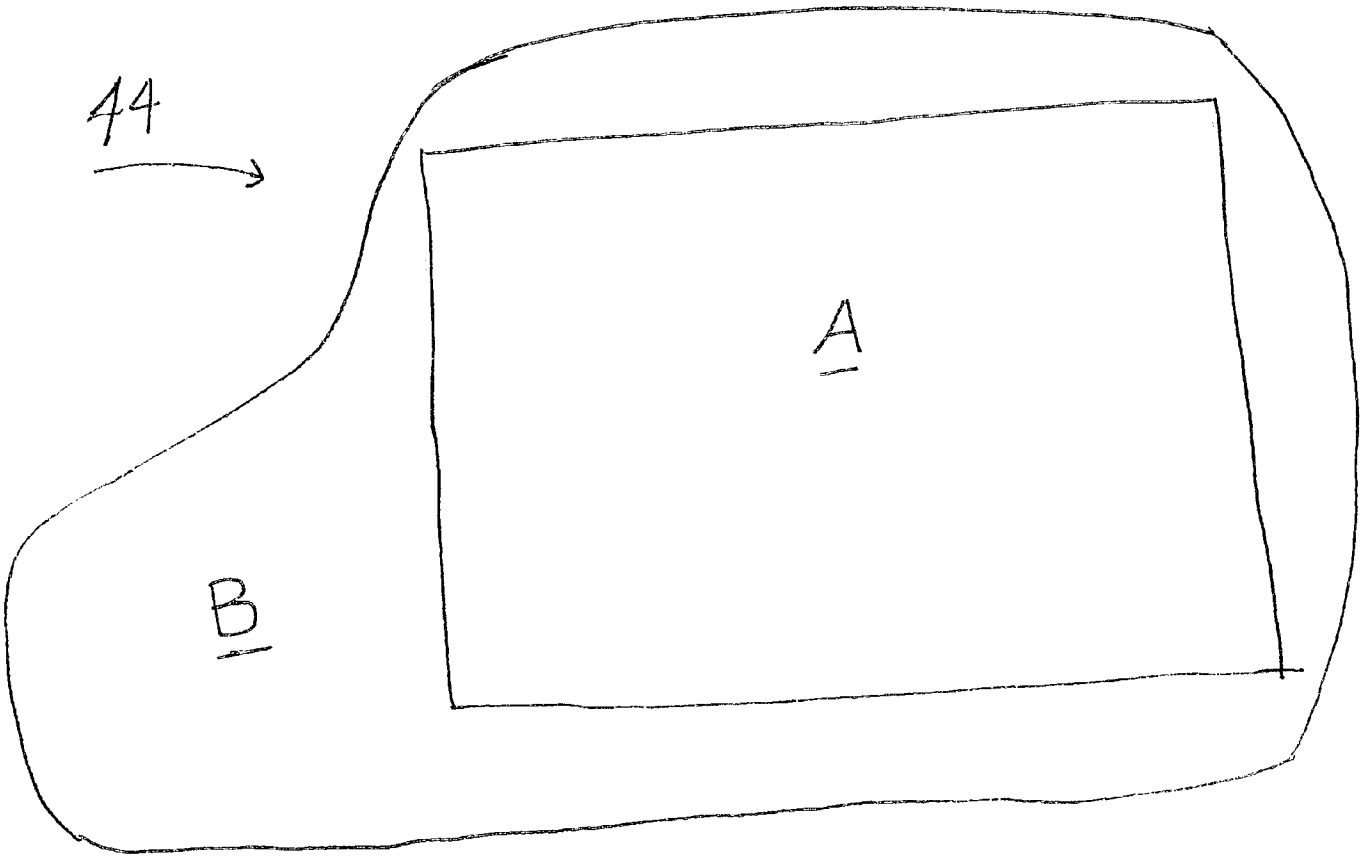
FIG. 5 is a diagrammatic representation of a cross-sectional area of a filter air intake.

Yet another aspect of the present invention is illustrated with respect to FIG. 5. The engine (not shown) must have a minimal volumetric air flow in order to operate properly. The volumetric air flow is determined by the cross-sectional area of the engine intake (not shown) and the velocity of the air entering the engine: Flow=Area×Velocity. Air that enters the engine, first passes through the filter air intake 44. Therefore, the volumetric air flow into the engine must be equivalent to the volumetric air flow through the filter air intake 44. In FIG. 5, the area A represents the minimal cross-sectional area of the air filter intake 44 necessary to maintain the required minimal volumetric air flow to the engine. In one embodiment of the present invention, the cross-sectional area of the filter air intake 44 is increased to a predetermined area B. The increase in cross-sectional area will have the effect of decreasing the velocity of air that passes through the filter air intake 44. The reduction in velocity provides the advantage of not pulling airborne debris as easily as faster moving air. Therefore, larger debris will not be pulled against the filter air intake 44. Also, any debris held against the filter air intake 44 may be more easily dislodged.

The combination of filter air intake location (facing away from front of trimmer), the filter air intake 44 lying in an angled plane P (away from the vertical), and reduced air velocity through the filter air intake 44 have the effect of significantly reducing the amount of debris pulled against the filter air intake.

The invention has been described with reference to preferred embodiments. Obviously, modifications and alterations will occur to others upon a reading and understanding of this specification. It is intended to include all such modifications and alternations in so far as they come within the scope of the appended claims or the equivalence thereof.

What is claimed is:

1. An apparatus including a frame mounted on a pair of wheels, said frame having a front end with respect to a forward direction of travel, cutting means adapted for cutting vegetation, an engine carried on said frame for providing power to drive said cutting means, and means for supplying air to said engine, wherein said engine has an associated engine air intake having a first cross-sectional area $A_1$, and said air is supplied at a predetermined air volumetric flow rate, F, to define a constant first velocity $V_1$, wherein $V_1=F/A_1$, the apparatus comprising:

filtering means for filtering said air supplied to said engine, said filtering means including a generally planar filter air intake having an associated second cross-sectional area $A_2$, wherein at said predetermined air volumetric flow rate F, $A_2$ has a predetermined value so that the velocity, $V_2$, of air passing through said filter air intake is less than $V_1$, wherein $V_1-V_2$ is a predetermined amount, wherein said filter air intake is positioned downwardly with respect to a plane normal to said forward direction of travel.

2. The apparatus of claim 1 wherein said filtering means is positioned relative to said frame so that said filter air intake generally faces away from said front end.

3. The apparatus of claim 1 wherein said filter air intake lies generally in a plane which is angled away from the front end of the frame by an angle between 5° and 85° with respect to a plane normal to said forward direction of travel.

4. The apparatus of claim 1 wherein said apparatus is a string trimmer and wherein said cutting means comprises:

a plurality of cords; and, rotating means for rotating said cords, said rotating means being powered by said engine.

5. An apparatus of claim 1, wherein said apparatus is a string trimmer.

6. An apparatus including a frame mounted on a pair of wheels, said frame having a front end with respect to a forward direction of travel, cutting means adapted for cutting vegetation, an engine carried on said frame for providing power to drive said cutting means, and means for supplying air to said engine, the apparatus comprising:

filtering means for filtering said air supplied to said engine, said filtering means including a generally planar filter air intake having at least a minimal cross-sectional area effective to maintain a minimal volumetric air flow to said engine, wherein said filtering means is positioned relative to said frame so that said filter air intake generally faces away from said front end, wherein said filtering air intake is positioned downwardly.

7. The apparatus of claim 6 wherein said filter air intake lies generally in a plane which is angled away from the front end of the frame by an angle between 5° and 85° with respect to a plane normal to said direction of travel.

8. The apparatus of claim 6 wherein said cross-sectional area of said filter air intake is greater than said minimal cross-sectional area to reduce the velocity of air passing through said filter intake.

9. The apparatus of claim 6, wherein said apparatus is a string trimmer.

10. In an apparatus including a frame mounted on a pair of wheels, said frame having a front end with respect to a forward direction of travel, cutting means adapted for cutting vegetation, an engine carried on said frame for providing power to drive said cutting means, and means for supplying air to said engine, a method for reducing engine failure due to overheating because of a clogged air filter, the method comprising the steps of:

providing filtering means for filtering said air supplied to said engine, said filtering means including a generally planar filter air intake, said filtering air intake being positioned downwardly; and, positioning said filtering means relative to said frame so that said filter air intake generally faces away from said front end.

11. The method of claim 8 further comprising the step of: positioning said filtering means so that said filter air intake lies generally in a plane which is angled away from the front end of the frame by an angle between 5° and 85° with respect to a plane normal to said direction of travel.

12. The apparatus of claim 10, wherein said air apparatus is a string trimmer.

* * * * *